US007308916B2

(12) United States Patent
Akuzawa et al.

(10) Patent No.: US 7,308,916 B2
(45) Date of Patent: Dec. 18, 2007

(54) BEVERAGE DISPENSER

(75) Inventors: Takayuki Akuzawa, Gunma-gun (JP); Masayuki Taguchi, Isesaki (JP); Isao Ishizaki, Isesaki (JP); Kimihisa Ishikawa, Sawa-gun (JP); Hideki Sadakata, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 172 days.

(21) Appl. No.: 11/298,687

(22) Filed: Dec. 12, 2005

(65) Prior Publication Data

US 2006/0191592 A1 Aug. 31, 2006

(30) Foreign Application Priority Data

Dec. 20, 2004 (JP) ..... 2004-368095

(51) Int. Cl.
*B65B 43/42* (2006.01)

(52) U.S. Cl. ..... 141/174; 141/172; 141/275; 221/221

(58) Field of Classification Search ..... 141/2, 141/18, 172, 174, 250, 275; 221/221–223
See application file for complete search history.

(56) References Cited

U.S. PATENT DOCUMENTS

| | | | | |
|---|---|---|---|---|
| 2,307,589 | A * | 1/1943 | Johnson | 141/165 |
| 2,571,283 | A * | 10/1951 | Nicholson | 141/174 |
| 4,625,776 | A * | 12/1986 | Mikkelsen | 141/83 |
| 5,000,345 | A * | 3/1991 | Brogna et al. | 221/5 |
| 5,261,467 | A * | 11/1993 | Yamamoto et al. | 141/174 |
| 6,688,460 | B2 * | 2/2004 | Kim | 198/750.1 |

FOREIGN PATENT DOCUMENTS

JP 6-333154 2/1994

* cited by examiner

*Primary Examiner*—Timothy L. Maust
(74) *Attorney, Agent, or Firm*—Banner & Witcoff, Ltd.

(57) ABSTRACT

A beverage dispenser operates a cup holder to advance a cup holding portion holding a cup in which a beverage is filled from an inside of a cup port to an outside thereof to locate it above a cup mount, lower the cup holding portion from a above position by a predetermined distance to place the cup on the cup mount in process of lowering, and retreat the cup holding portion from a lowered position to the inside of the cup port to leave the cup on the cup mount.

7 Claims, 15 Drawing Sheets

BEVERAGE DISPENSER

BACKGROUND OF THE INVENTION (i) Field of the Invention

The present invention relates to a beverage dispenser for providing a purchaser with a cup in which a beverage is filled.

(ii) Description of the Related Art

This kind of a beverage dispenser contains beverage generating devices including a cup carrier, a water cleaner, a hot-water generator, material storehouses, a coffee extractor, an ice maker, an agitator and so on. The beverage dispenser generates a beverage by a predetermined procedure and provides a purchaser with a cup in which the beverage is filled based on money dropped in and selection of the beverage.

A conventional beverage dispenser has a cup mount provided an inside of a cup port and places the cup in which the beverage is filled on the cup mount. Therefore, the purchaser needs to put a hand in the cup port and take out the cup after manually opening the door or automatically opening the door.

A height position of the cup port is predetermined based on average height. Therefore, it happens that the cup gets hooked on an edge of the cup port and the beverage in the cup gets spilt in the case where the purchaser shorter or taller than the average height puts a hand in the cup port and takes out the cup.

SUMMARY OF THE INVENTION

An object of the present invention is to provide a beverage dispenser which has simplified a purchaser's operation for taking out a cup by placing the cup in which a beverage is filled on a cup mount provided at an outside of a cup port.

To attain the object, the beverage dispenser comprises: a cup port provided at a front surface of a body; a cup mount provided at an outside of the cup port; a cup holder including a cup holding portion, an internal diameter of the cup holding portion slightly smaller than a maximum external diameter of a cup in an external form like an inverted truncated cone, a right-to-left space of an opening of the cup holding portion slightly larger than a minimum external diameter of the cup, the cup holder capable of holding the cup with the cup holding portion; a holder mover capable of moving the cup holder at least forward and backward and upward and downward; and cup carryout control means for operating the cup holder so that the holding portion holding the cup is advanced from an inside of the cup port to the outside thereof to locate the holding portion above the cup mount, the cop holding portion is lowered from an above position by a predetermined distance to place the cup on the cup mount in process of lowering, and the cup holding portion is retreated from a lowered position to the inside of the cup port to leave the cup on the cup mount.

According to this beverage dispenser, it is possible to provide the cup in which the beverage is filled in front of the purchaser by a series of cup carryout operations of moving the cup holder to advance the cup holding portion holding the cup in which the beverage is filled from the inside of the cup port to the outside thereof to locate the cup holding portion above the cup mount, lower the cup holding portion from the above position by a predetermined distance to place the cup on the cup mount in process of lowering, and retreat the cup holding portion from the lowered position to the inside of the cup port to leave the cup on the cup mount.

Therefore, it is possible to simplify the purchaser's operation for taking out the cup by rendering the conventional operation of putting a hand in the cup port and taking out the cup unnecessary.

The object, other objects, features and advantages of the present invention will be clarified by the following description and the attached drawings.

DESCRIPTION OF THE PREFERRED EMBODIMENTS

FIGS. 1 to 15 show an embodiment of the present invention. The following description indicates top of FIG. 1 as the top, bottom of FIG. 1 as the bottom, left of FIG. 1 as the left, right of FIG. 1 as the right, a front side of FIG. 1 as the front, and a depth side of FIG. 1 as the back.

First, an overall configuration of a beverage dispenser will be described by referring to FIGS. 1 to 4.

Figure 1:
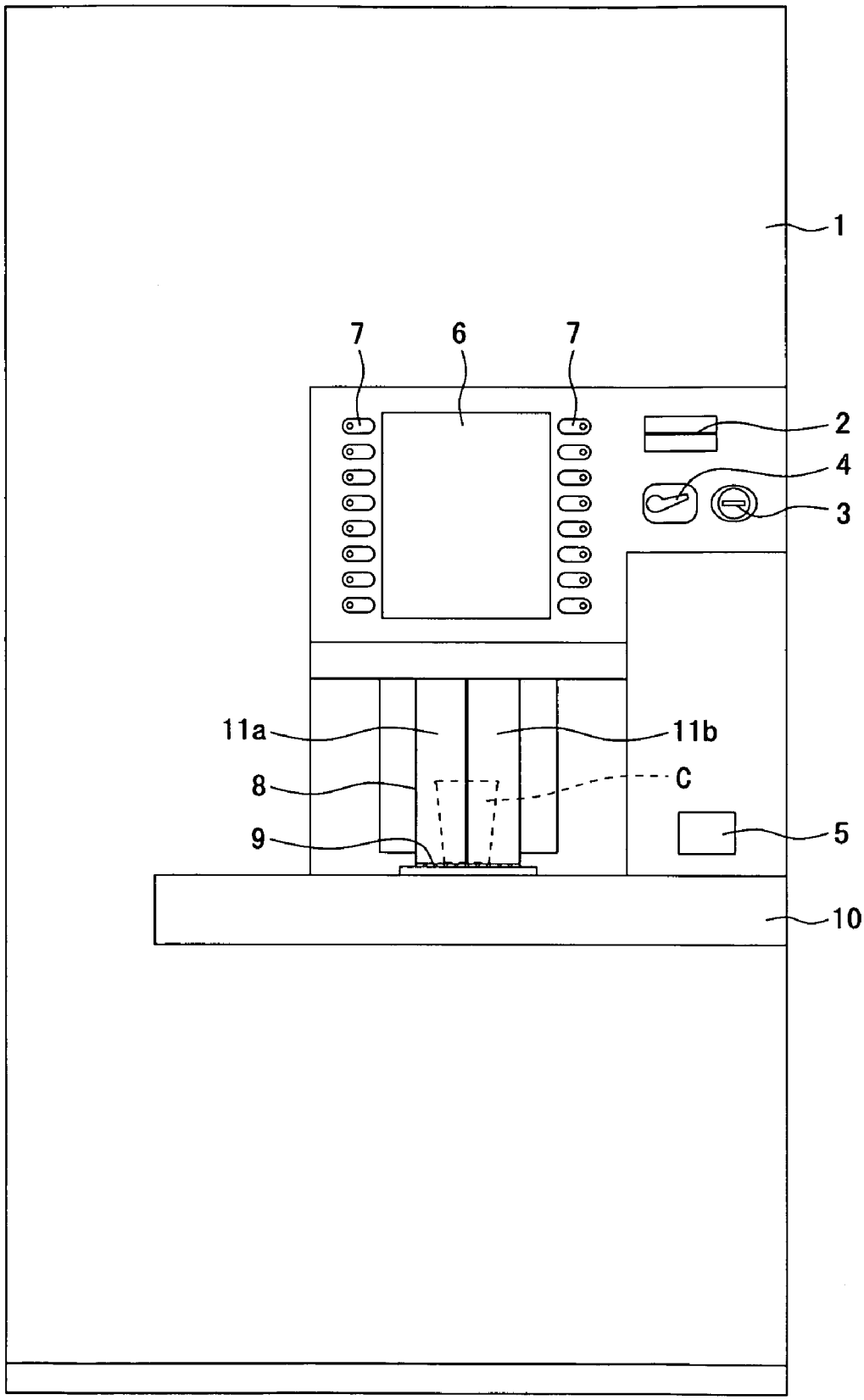
FIG. 1 is a front view of a beverage dispenser showing an embodiment of the present invention.

A body 1 shown in FIG. 1 comprises a cabinet (not shown) having a front opening and a door (no reference numeral) openable and closable provided at the front opening of the cabinet. Though not shown, the body 1 contains beverage generating devices and a holder mover described later. The beverage generating devices includes a cup carrier, a water cleaner, a hot-water generator, material storehouses, a coffee extractor, an ice maker, an agitator and so on.

At a front surface of the door of the body 1, there are a bill slot 2, a coin slot 3, a return lever 4, a coin return opening 5, a liquid crystal display 6 and multiple operation buttons 7 arranged on the right and left of the liquid crystal display 6. It is also possible to use a known display such as a CRT (Cathode Ray Tube) display or a PDP (Plasma Display Panel) instead of the liquid crystal display 6.

Below the liquid crystal display 6 at the front surface of the door, there are a cup port 8 in a vertically long rectangular form, a cup mount 9 provided at an outside of the cup port 8 and a simple table 10 provided under the cup mount 9. Furthermore, on the backside of the cup port 8, there are a pair of right and left slide doors 11*a*, 11*b* for opening and closing the cup port 8.

Figure 2:
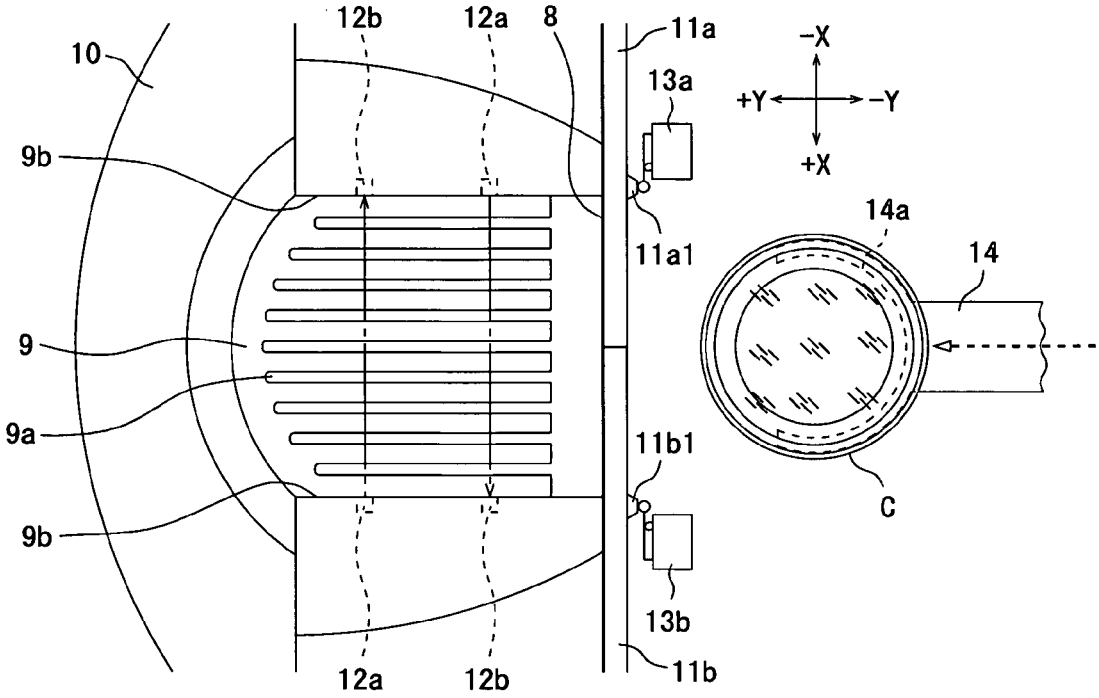
FIG. 2 is a top view of a cup port of FIG. 1.
Figure 3:
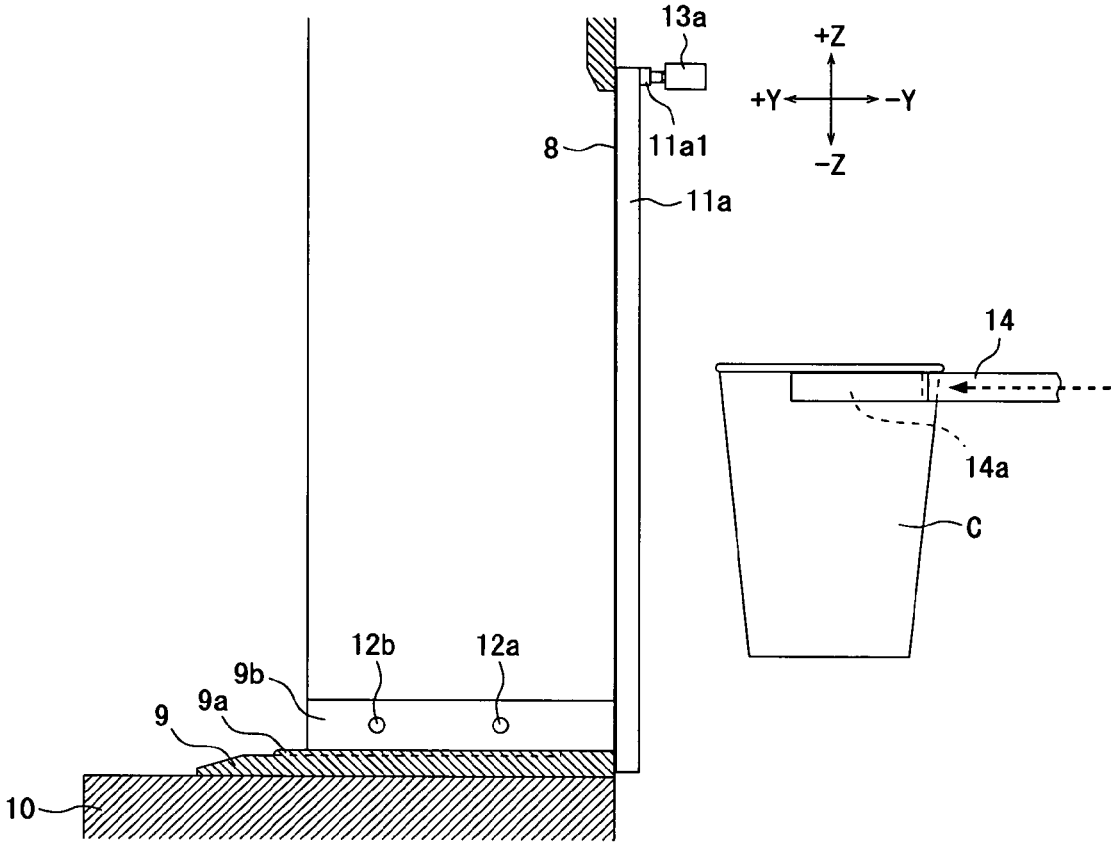
FIG. 3 is a longitudinal section of FIG. 2.

As shown in FIGS. 2 and 3, the cup mount 9 has sufficient area to have a cup C mentioned later mounted thereon, and also has multiple convex streaks 9*a* at intervals rightward and leftward. On the right and left of the cup mount 9, there are wall surfaces 9*b* of a predetermined height for limiting right-to-left movement of the cup C.

Furthermore, on the right and left of the wall surfaces 9*b*, there are two object detection sensors 12 (refer to FIG. 4) for detecting whether or not there is an object on the cup mount 9 with spacing before and after. As for each of the object detection sensors 12, it is possible to use a transmission photosensor configured by a light emitting element 12*a* such as a photodiode and a light receiving element 12*b* such as a phototransistor for instance. In the case of using the photosensors as the object detection sensors 12 and placing them alongside, the light emitting elements 12*a* of the photosensors are provided on mutually different wall surfaces as shown in FIG. 2 so as not to cause a malfunction by having light from the light emitting element 12*a* of one photosensor incident on the light receiving element 12*b* of the other photosensor. As a matter of course, the number of the object detection sensors may also be one, or three or more.

The pair of right and left slide doors 11*a*, 11*b* are normally closing the cup port 8, and open the cup port 8 on carrying out the cup C by moving rightward and leftward as if separating from each other. As for means for opening and closing the slide doors 11*a*, 11*b*, it is possible to adopt a mechanism comprising parts such as a spring for biasing the slide doors 11*a*, 11*b* to come close to each other and keeping a state of closing, a pressed surface such as a curved surface provided symmetrically on the backside of each of the slide doors 11*a*, 11*b*, and a roller for pressing the pressed surface of each of the slide doors 11*a*, 11*b* by advancing a cup holder 14 to operate the slide doors 11*a*, 11*b* to separate from each other. It is also possible, as a matter of course, to adopt a mechanism for comprising parts such as a spring for biasing the slide doors 11*a*, 11*b* to come close to each other and keeping a state of closing, a rack provided on the backside of each of the slide doors 11*a*, 11*b*, a pinion engaging the rack of each of the slide doors 11*a*, 11*b*, and a motor for rotating each of the pinions.

At positions in proximity to the tops of the slide doors 11*a*, 11*b*, there are closing detection sensors 13*a*, 13*b* for detecting the closing of the slide doors 11*a*, 11*b*. For instance, microswitches may be used for the closing detection sensors 13*a*, 13*b*. In the case of using the microswitches as the closing detection sensors 13*a*, 13*b*, projections 11*a*1, 11*b*1 for operating the microswitches at door closing positions are provided at the tops of the slide doors 11*a*, 11*b* as shown in FIG. 2.

The cup C is in the external form like an inverted truncated cone, and has circular ribs on its top peripheral edge. The cup C consists of an inflammable material such as paper, where an external diameter of the circular rib existing on the top edge is largest and the external diameter on the bottom edge is smallest. A large number of the cups C are stacked and housed in the cup carrier, and are dropped and carried out one by one from the cup carrier.

The cup holder 14 has a cup holding portion 14*a* of which top surface is approximately C-shaped on its tip. An internal diameter L1 (refer to FIG. 12) of the cup holding portion 14*a* is slightly smaller than a maximum external diameter of the cup C, and a right-to-left space L2 (refer to FIG. 12) of an opening of the cup holding portion 14*a* is slightly larger than a minimum external diameter of the cup C. To be more specific, if the cup C is dropped from above the cup holding portion 14*a*, the cup C stops in a state of having the circular rib engaged with an inner peripheral edge of the cup holding portion 14*a* so as to be held by the cup holding portion 14*a*. According to this embodiment, the maximum external diameter of the cup C is the external diameter of the circular rib. However, similar automatic holding is also possible by determining a held part of the cup C in a lower part than the circular rib and setting the internal diameter L1 of the cup holding portion 14*a* slightly smaller than the external diameter of the held part.

The cup holder 14 can be moved by an unshown holder mover in ±X direction (rightward and leftward), ±Y direction (forward and backward) and ±Z direction (upward and downward) shown in FIGS. 2 and 3, that is, three-dimensional movement in the body 1. The holder mover comprises an X-axis motor Mx, a Y-axis motor My and a Z-axis motor Mz (refer to FIG. 4) and motion converting mechanisms (not shown) for each axis. Each of the motion converting mechanisms converts rotary motion of each motor to linear motion and conveying it to the cup holder 14 by parts such as a ball screw, a nut engaged with the ball screw and a linear guide. Concerning a cup carryout operation described later, it is sufficient if the holder mover can move the cup holder 14 at least in the ±Y direction and ±Z direction.

Figure 4:
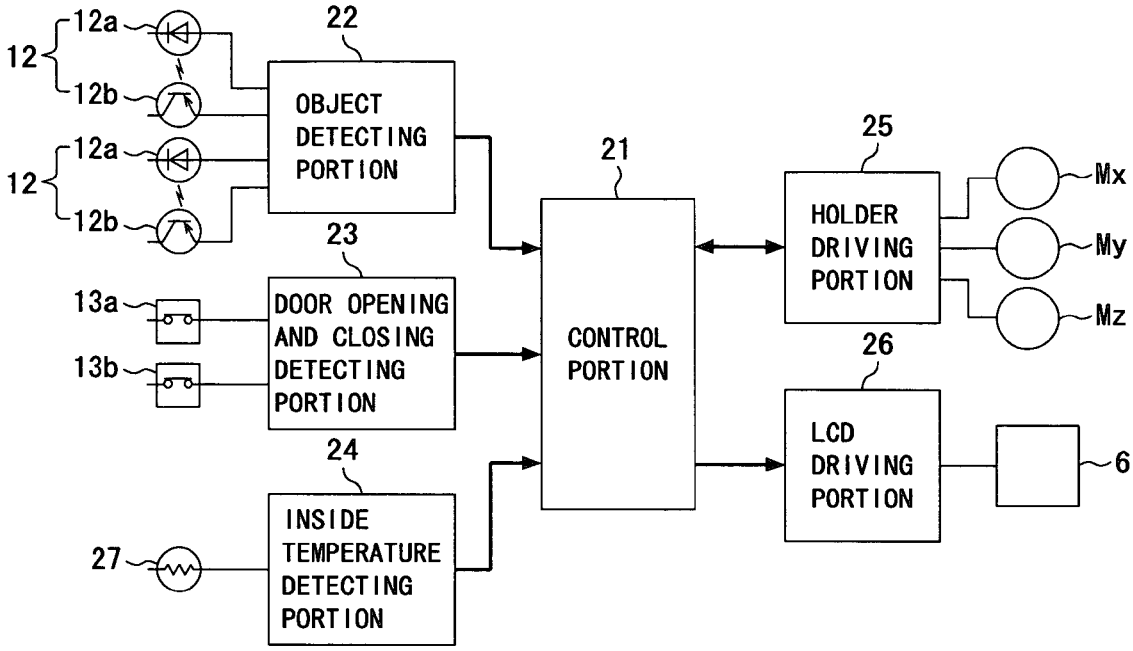
FIG. 4 is a block diagram of a control system.

A control portion 21 shown in FIG. 4 has a microcomputer configuration. A memory of the control portion 21 stores a program related to beverage blending before carrying out the cup C, a program related to the cup carryout operation shown in FIGS. 14 and 15, character data and image data to be displayed on the liquid crystal display 6, reference current data for overload determination and the like.

An object detecting portion 22 sends detection signals of the two object detection sensors 12 to the control portion 21. A door opening and closing detecting portion 23 sends the detection signals of the detection sensors 13*a*, 13*b* to the control portion 21. An inside temperature detecting portion 24 sends the detection signals of a temperature sensor 27 such as a thermistor placed in the body 1 to the control portion 21.

A holder driving portion 25 sends an individual motor driving signal to each of the X-axis motor Mx, Y-axis motor My and Z-axis motor Mz of the holder mover based on a control signal from the control portion 21 and detects a current passing in the Z-axis motor Mz so as to send the detection signals to the control portion 21. A display driving portion 26 sends an image display signal to the liquid crystal display 6 based on a control signal and an image signal from the control portion 21.

Next, a description will be given as to the cup carryout operation implemented by the aforementioned beverage dispenser.

Salable beverage kinds and an operation method are displayed on the liquid crystal display 6. Therefore, according to the indication on the liquid crystal display 6, a purchaser selects a beverage with the operation buttons 7 and drops in the money required to purchase the beverage.

After having the money dropped in and the beverage selected, the cup holder 14 moves to a carryout position of the cup carrier so as to receive the cup C dropped and carried from the cup carrier. As previously described, the internal diameter L1 (refer to FIG. 12) of the cup holding portion 14*a* is slightly smaller than the maximum external diameter of the cup C, and so if the cup C is dropped from above the cup holding portion 14*a*, the cup C is automatically held by the cup holding portion 14*a*.

After receiving the cup C, the cup holder 14 moves in the body 1 according to a predetermined procedure, and a desired beverage is generated in the cup C in the moving process. For instance, in the case where coffee with cream and sugar is selected as the beverage, the cup holder 14 moves in the body 1 according to the predetermined procedure so as to have sugar powder and milk powder dropped into the cup C from the material storehouses, coffee liquid extracted by the coffee extractor filled in the cup C and agitated.

Figure 14:
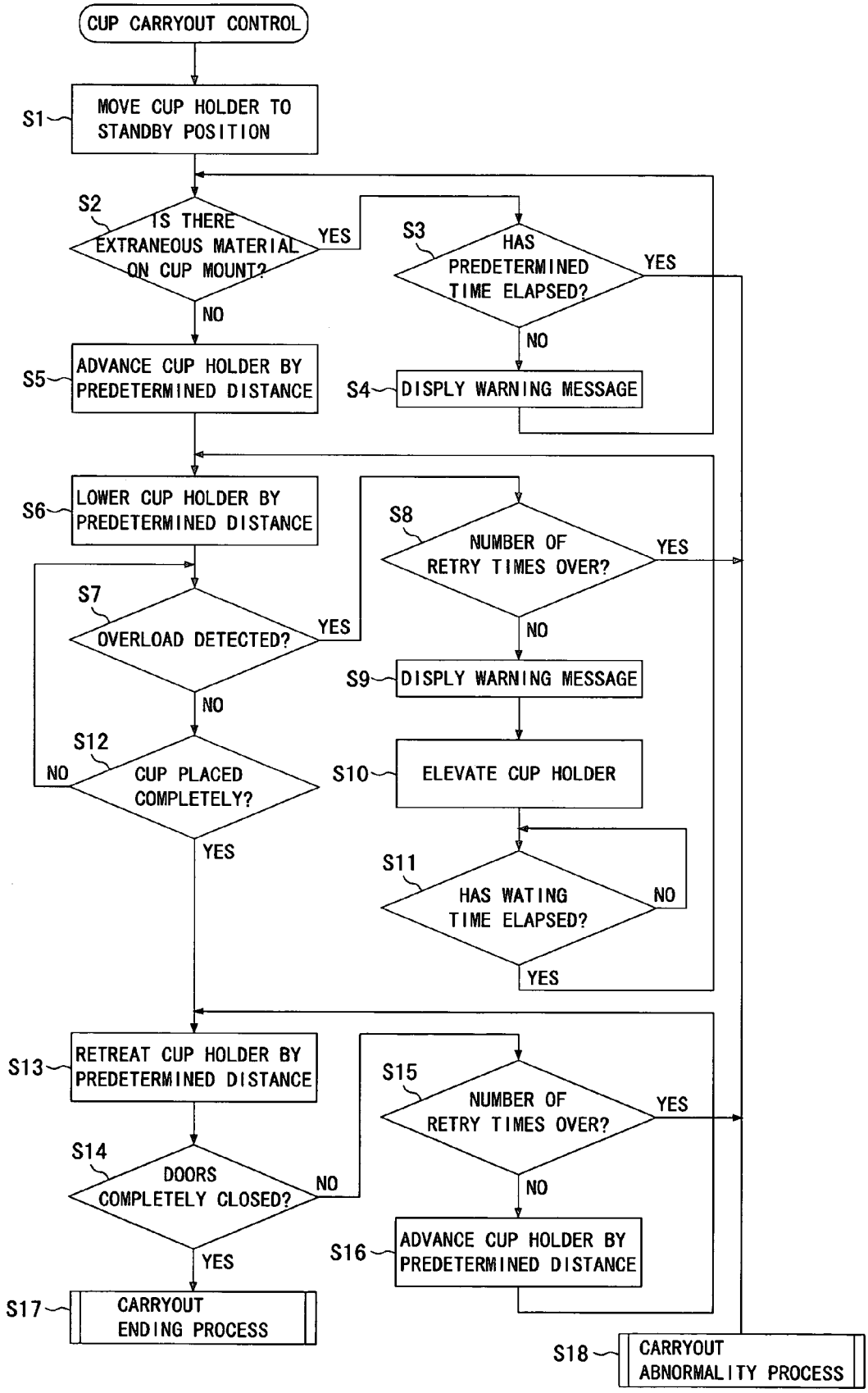
FIG. 14 is a diagram showing a program flow related to cup carryout control.
Figure 15:
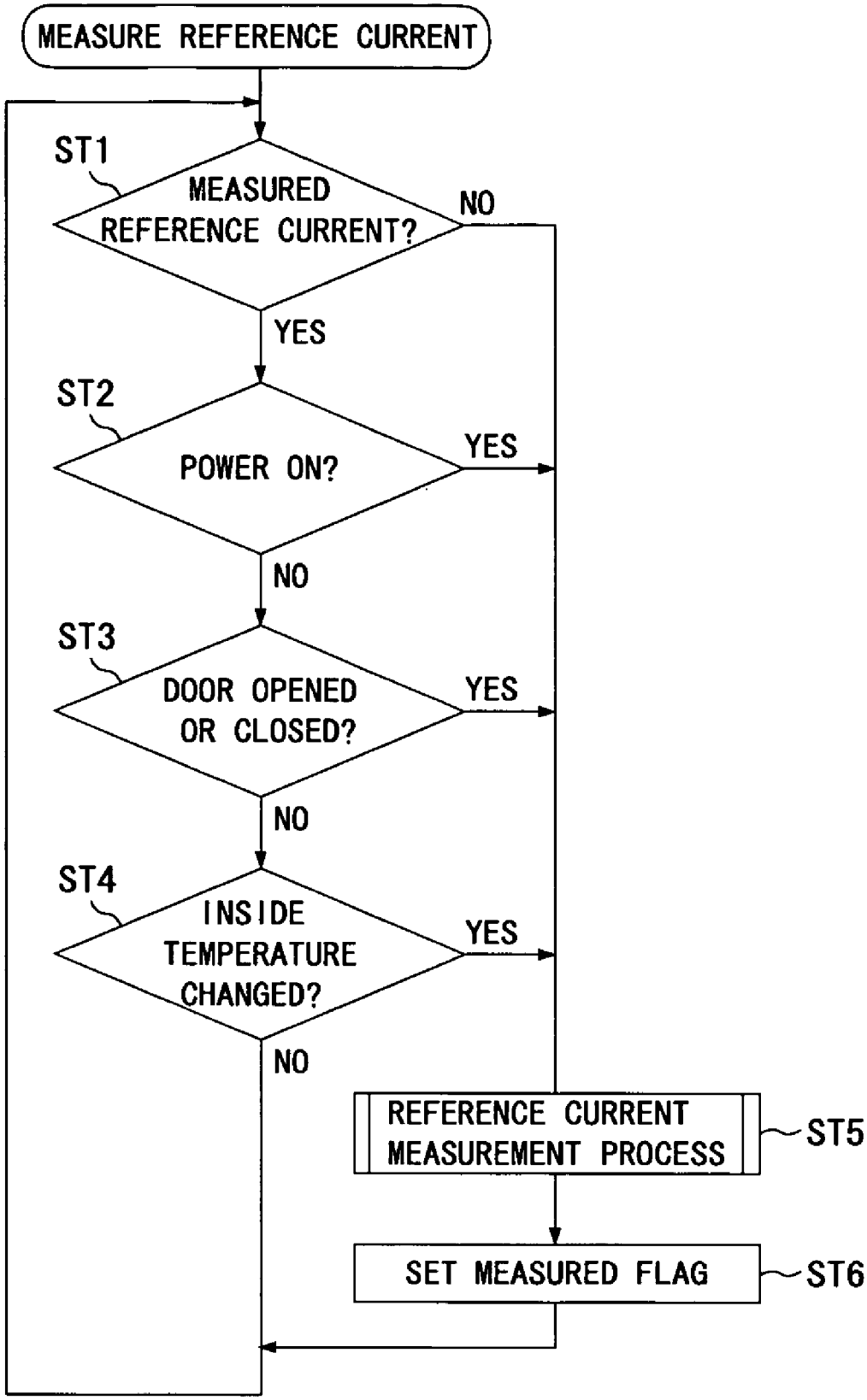
FIG. 15 is a diagram showing a program flow related to reference current measurement.

After completing generation of the beverage, the cup holder 14 holding the cup C in which the beverage is filled moves to a standby position set up an inside of the cup port 8 and stops as shown in FIGS. 2 and 3 (step S1 of FIG. 14).

And it determines whether or not there is an extraneous material EM on the cup mount 9, which becomes an obstacle on placing the cup C on the cup mount 9, based on the detection signals of the object detection sensors 12 (step S2 of FIG. 14).

Figure 5:
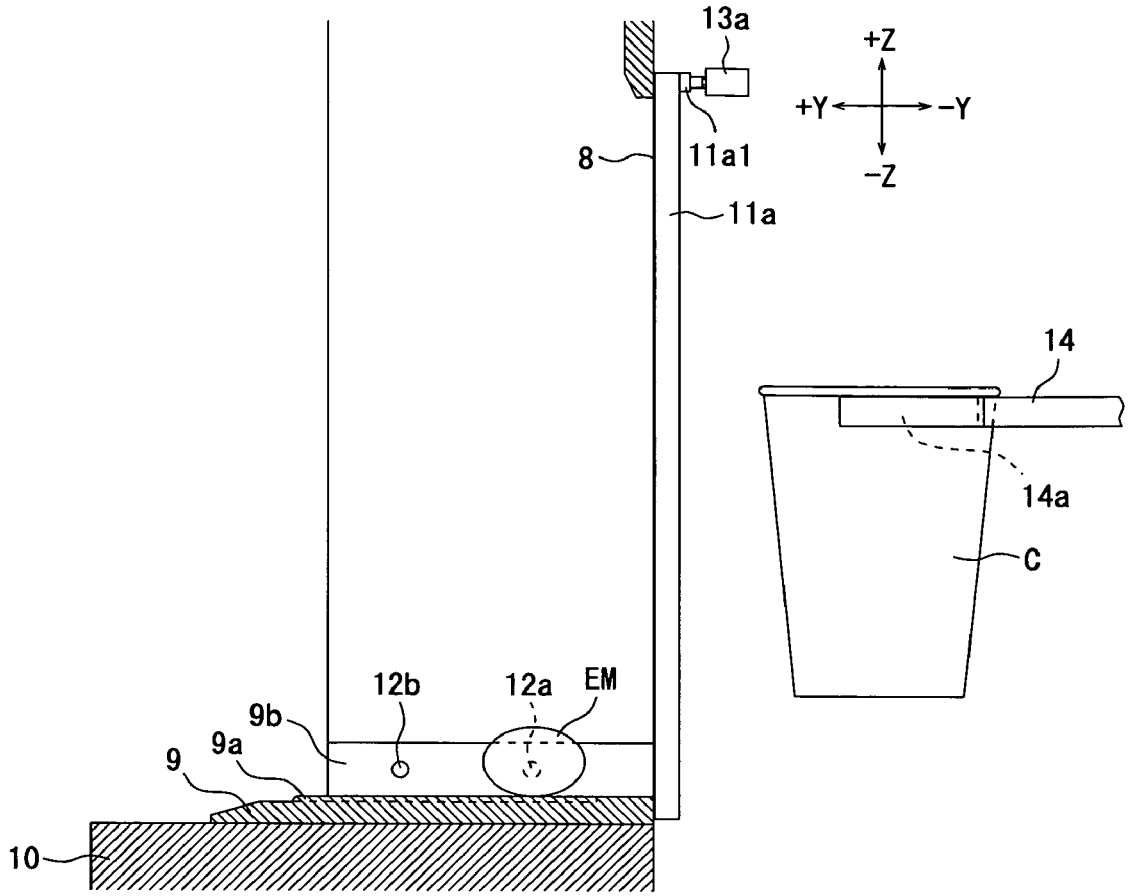
FIG. 5 is an explanatory diagram of a cup carryout operation.

As shown in FIG. 5, in the case where the extraneous material EM such as paper waste is on the cup mount 9 and it is detected by at least one of the object detection sensors 12, a warning message such as "Remove the extraneous material on the cup mount" is displayed on the liquid crystal display 6 or a buzz is generated or both are performed to give a warning for prompting removal of the extraneous material (step S4 of FIG. 14). If the extraneous material is not removed after elapse of a predetermined time from the warning, it moves on to a step S18 to perform a carryout abnormality process (step S5 of FIG. 14). The carryout abnormality process in this case indicates a process for performing an error display on the liquid crystal display 6 and stopping the cup carryout operation to put an end to selling of the beverage.

Figure 6:
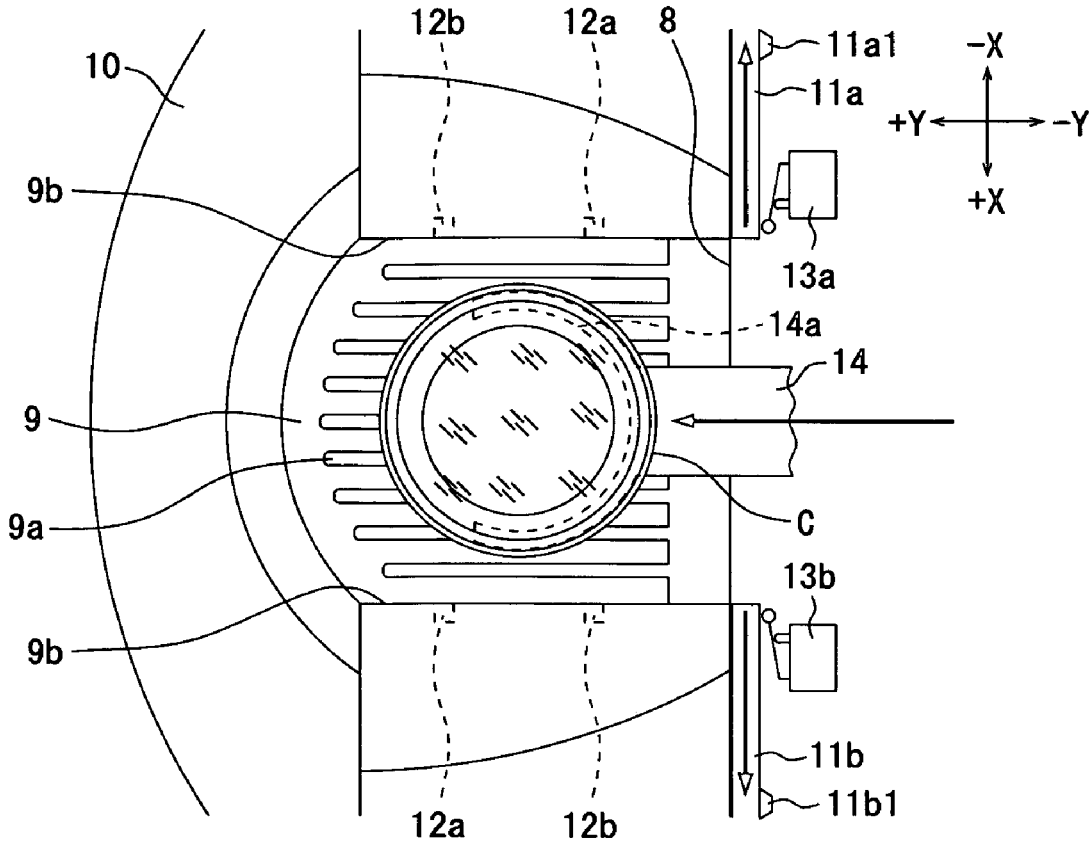
FIG. 6 is an explanatory diagram of the cup carryout operation.
Figure 7:
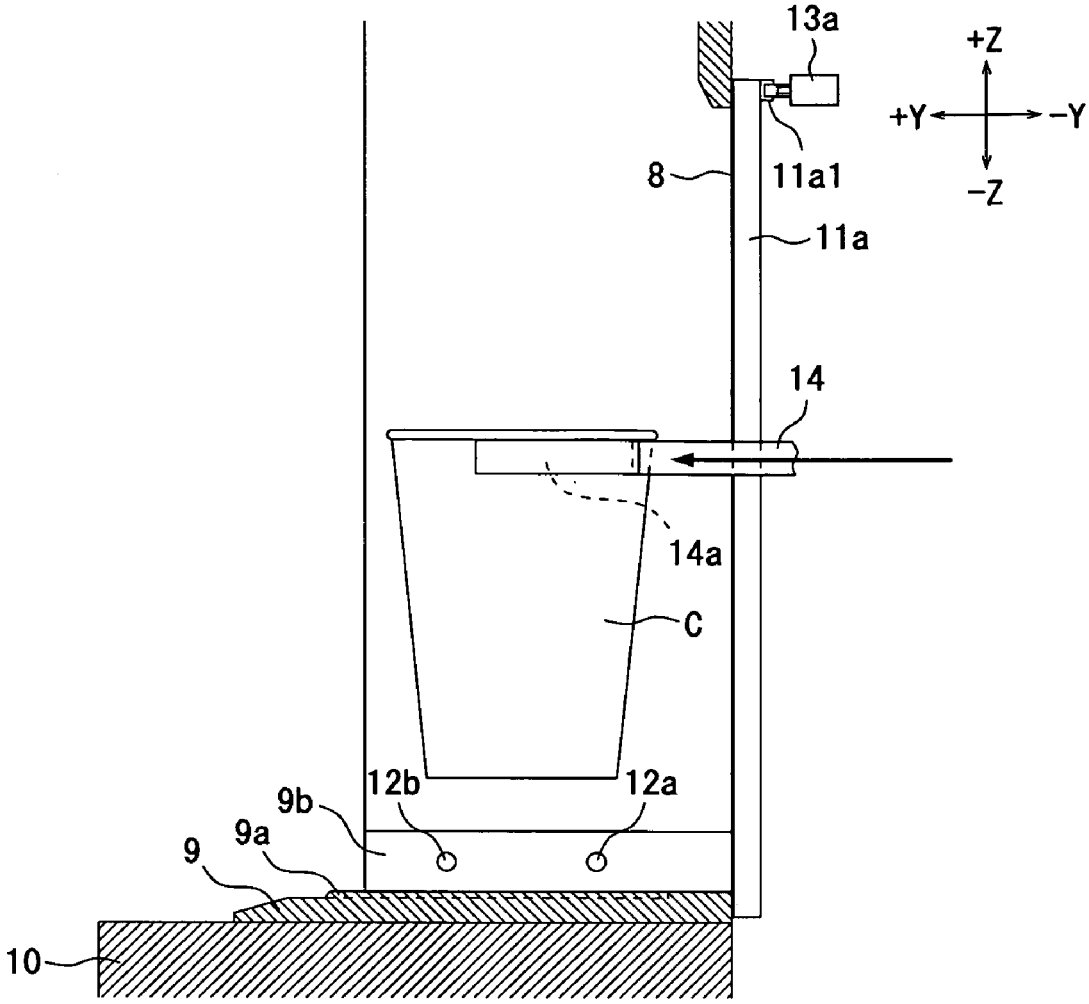
FIG. 7 is an explanatory diagram of the cup carryout operation.

As shown in FIGS. 6 and 7, if determined that there is no extraneous material EM on the cup mount 9 in the step S2, the cup holder 14 is advanced from the standby position by a predetermined distance in the +Y direction. At the same time, the slide doors 11*a*, 11*b* are moved rightward and leftward to separate from each other so as to open the cup port 8 (step S5 of FIG. 14). Thus, the cup C held by the cup holding portion 14*a* of the cup holder 14 advances from the inside of the cup port 8 to the outside thereof to be positioned above the cup mount 9.

Figure 8:
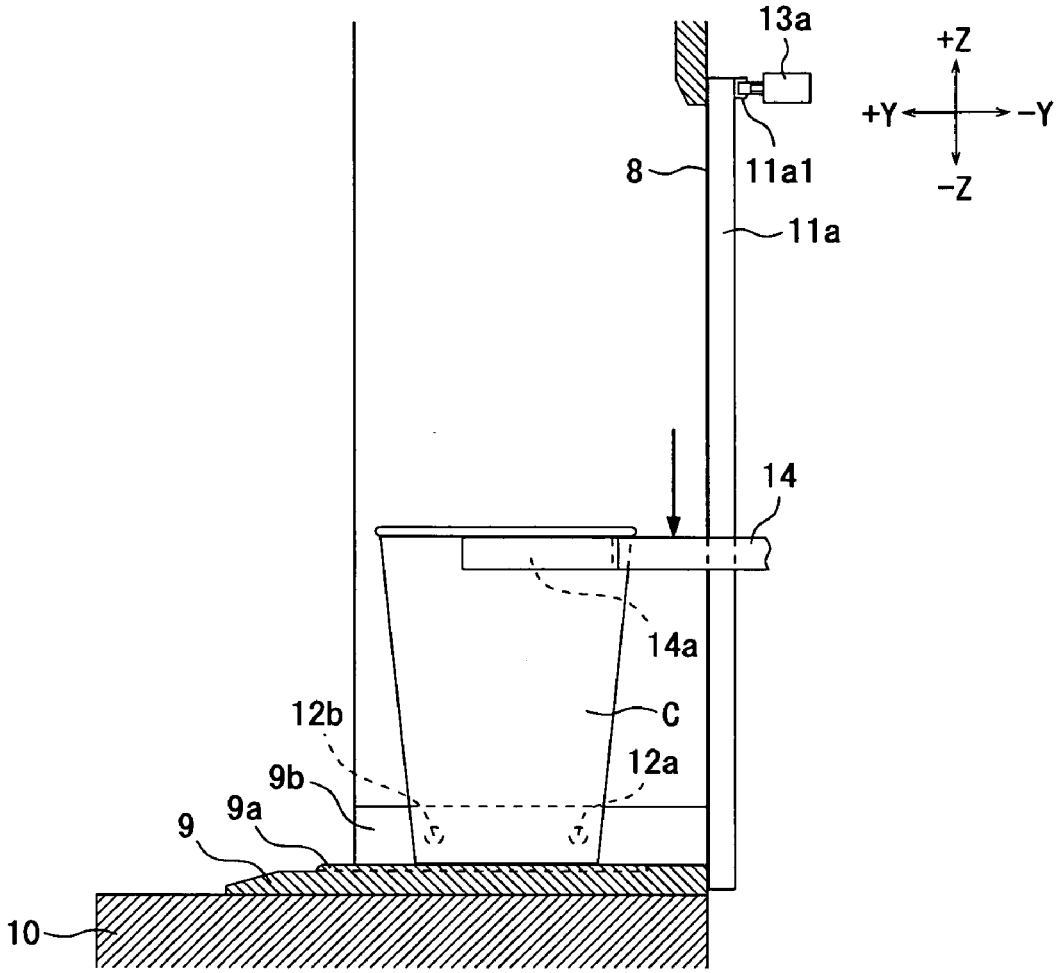
FIG. 8 is an explanatory diagram of the cup carryout operation.
Figure 9:
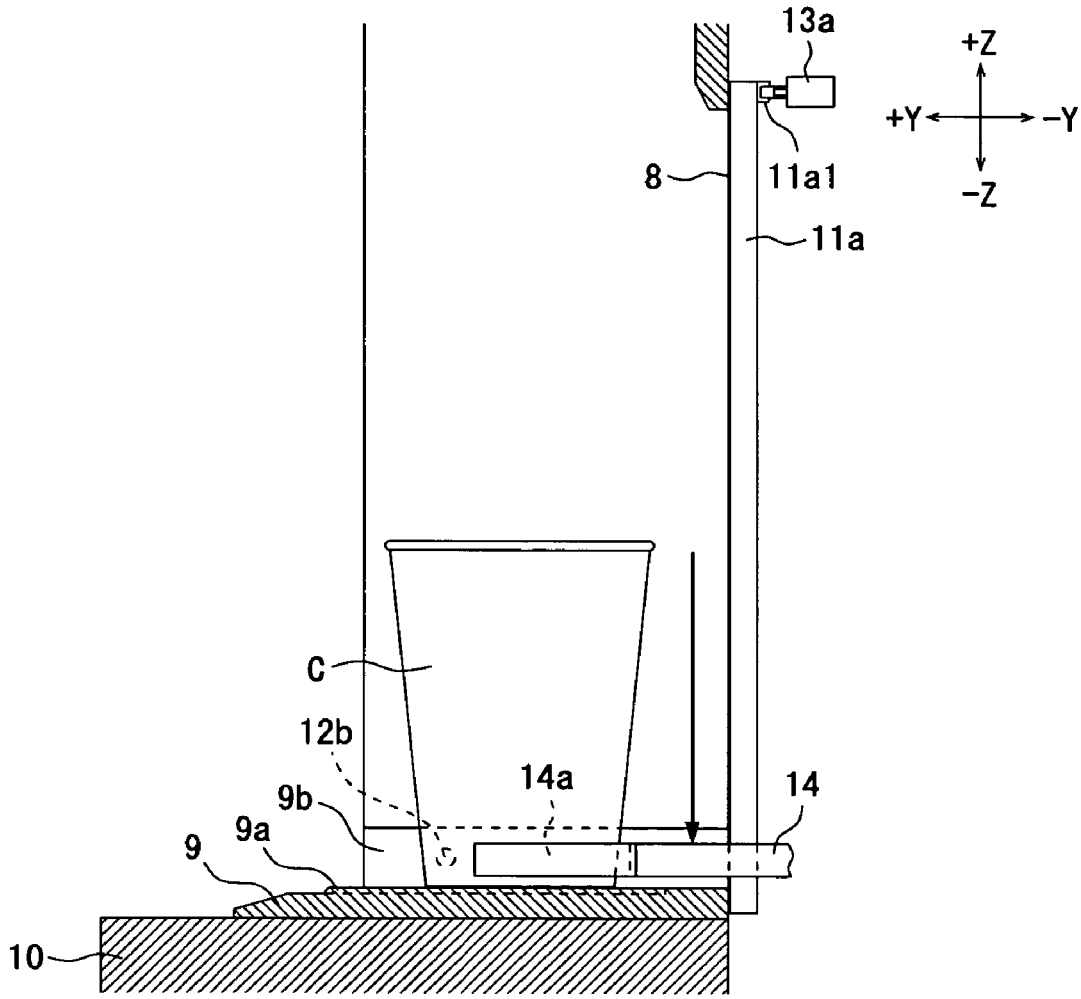
FIG. 9 is an explanatory diagram of the cup carryout operation.

As shown in FIGS. 8 and 9, after advancing the cup holder 14 by the predetermined distance, the cup holder 14 holding the cup C in which the beverage is filled is lowered from an above position by a predetermined distance in the −Z direction (step S6 of FIG. 14). The lowering distance of the cup holder 14 is set up based on the height position at which the right-to-left space L2 (refer to FIG. 12) of the opening of the cup holding portion 14*a* becomes larger than the external diameter of the cup C.

When lowering the cup holder 14, it is determined whether or not the overload ungenerable by normal operation is applied to lowering of the cup holder 14 based on the current passing through the Z-axis motor Mz detectable by the holder driving portion 25 (step S7 of FIG. 14).

To be more precise, the current passing through the Z-axis motor Mz on normally lowering the cup holder 14 is measured in advance, and a digital value thereof is stored as a reference current Is in the memory of the control portion 21. And when actually lowering the cup holder 14, a variation Ic (Ic=Ia−Is) on having an A/D conversion value Ia of the current passing through the Z-axis motor Mz exceeding the reference current Is is monitored so as to determine that there is the overload if the variation Ic is a stipulated value or higher.

Figure 10:
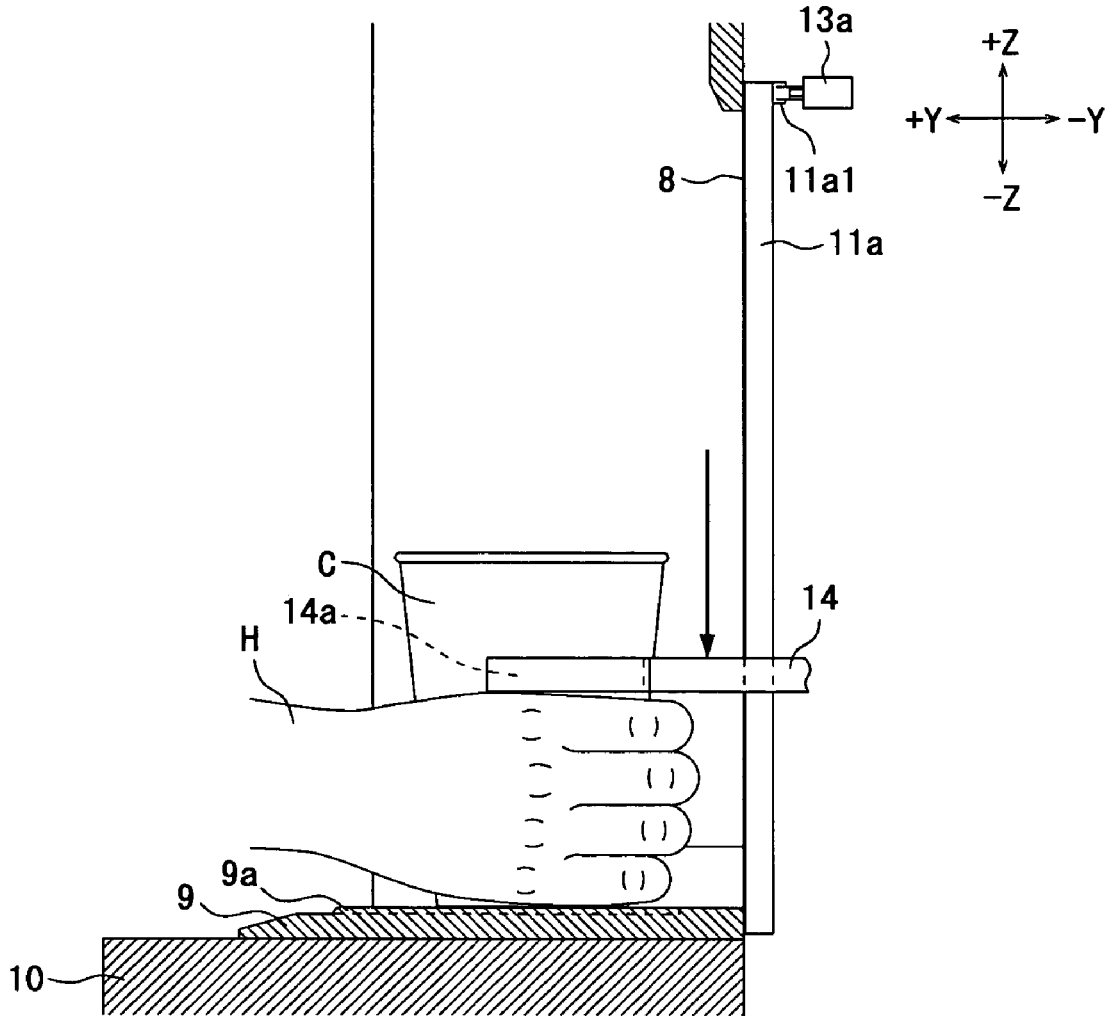
FIG. 10 is an explanatory diagram of the cup carryout operation.
Figure 11:
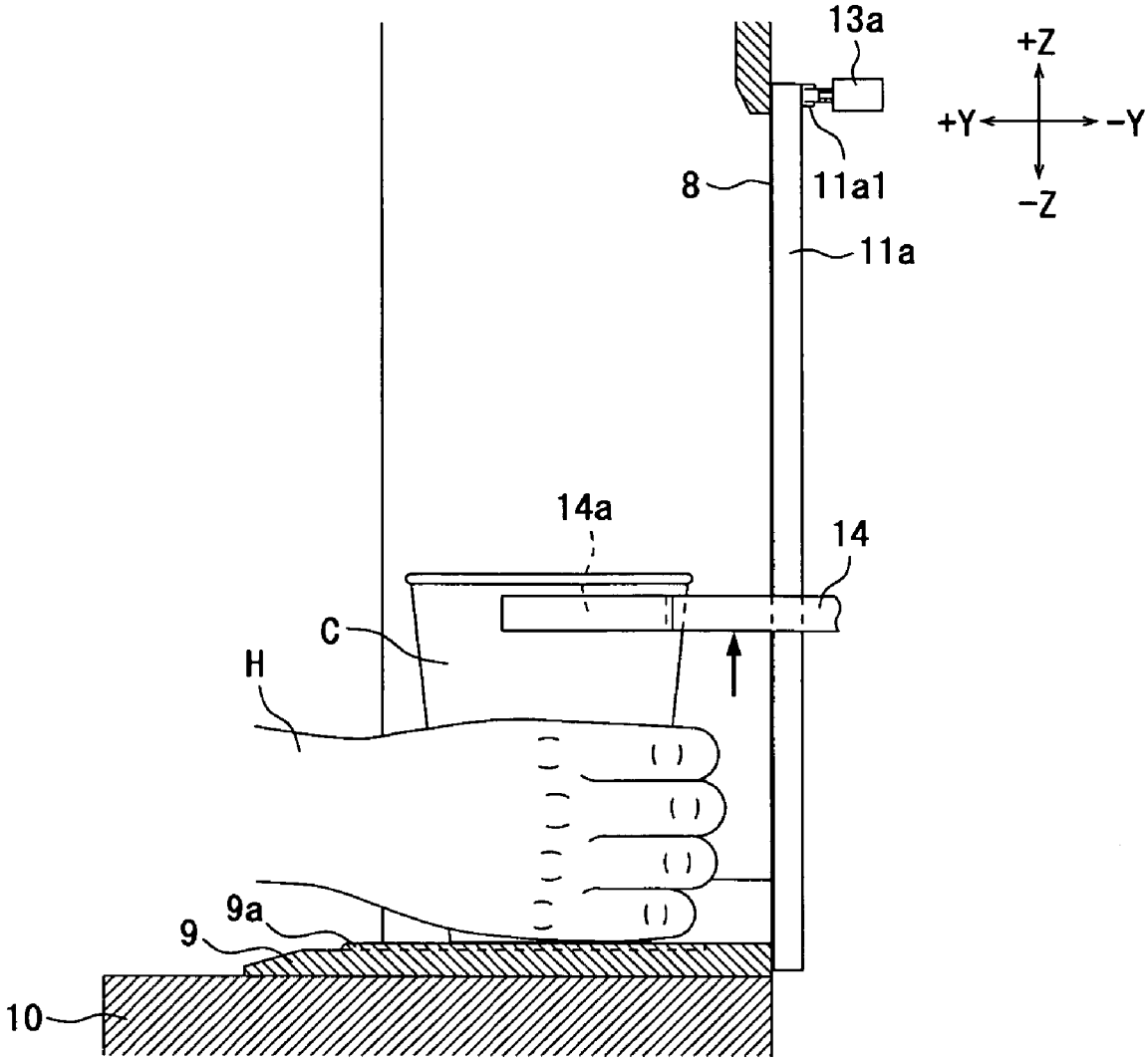
FIG. 11 is an explanatory diagram of the cup carryout operation.

For instance, as shown in FIG. 10, in the case where the cup C is held by a hand H of the purchaser while the cup holder 14 is lowering halfway and the hand H is sandwiched between the cup holder 14 and the cup mount 9, it is determined that there is the overload because the variation Ic becomes the stipulated value or higher. When determined that there is the overload, the warning message such as "Release your hand from the cup" is displayed on the liquid crystal display 6 or a buzz is generated or both are performed to give the warning for prompting the removal of the overload (step S9 of FIG. 14). At the same time, the cup holder 14 is elevated and stopped in an elevated state for a predetermined time (waiting time) as shown in FIG. 11 in order to allow the sandwiched hand H to be easily pulled out (steps S10 and S11 of FIG. 14). The processes of the steps S9 to S11 are retried by a predetermined number of times. If the abnormality is not resolved by retrying them the predetermined number of times, it moves on to the step S18 to perform the carryout abnormality process (step S8 of FIG. 14). The carryout abnormality process in this case indicates the process for performing an error display on the liquid crystal display 6 and retreating the cup holder 14 to the inside of the cup port 8 to put an end to selling of the beverage thereafter.

If not determined that there is the overload in the step S7, it is determined whether or not the cup C is placed on the cup mount 9 by the lowering of the cup holder 14 based on the detection signals of the object detection sensors 12 (step S12 of FIG. 14).

Figure 12:
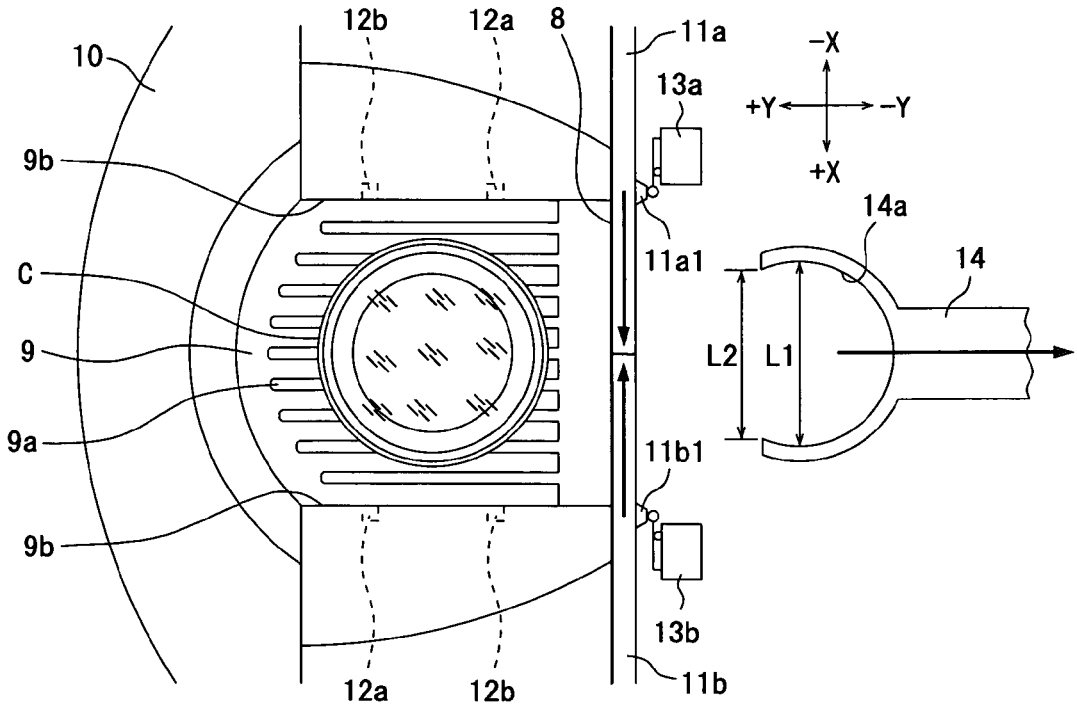
FIG. 12 is an explanatory diagram of the cup carryout operation.
Figure 13:
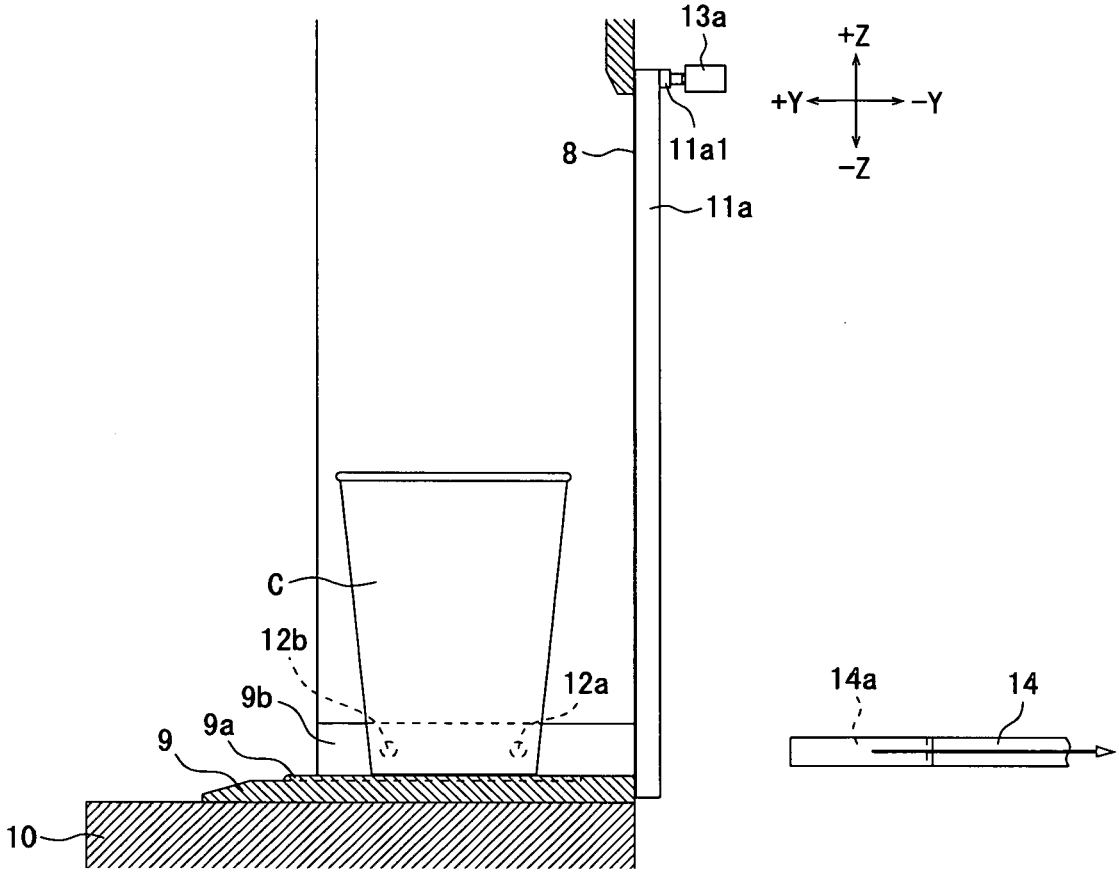
FIG. 13 is an explanatory diagram of the cup carryout operation.

As shown in FIG. 8, in the case where the cup C is normally placed on the cup mount 9 and the existence of the cup C is detected by the object detection sensor 12, the cup holder 14 is retreated from a lowered position by a predetermined distance in the −Y direction after waiting until the cup holder 14 lowers by the predetermined distance so as to move the cup holding portion 14*a* from the outside of the cup port 8 to the inside thereof as shown in FIGS. 12 and 13 (step S13 of FIG. 14). As previously described, the right-to-left space L2 (refer to FIG. 12) of the opening of the cup holding portion 14*a* is slightly larger than the minimum external diameter of the cup C. Therefore, if the cup holder 14 is retreated after lowering the cup holder 14, it is possible to release the holding by the cup holding portion 14*a* so as to leave the cup C in which the beverage is filled on the cup mount 9.

When retreating the cup holder 14, it is determined whether or not the slide doors 11*a*, 11*b* are normally closed based on the detection signals of the closing detection sensors 13*a*, 13*b* (step S14 of FIG. 14).

In the case where the slide doors 11*a*, 11*b* are not normally closed due to a failure, a mischief or the like, the operation of advancing the cup holder 14 by the predetermined distance in the +Y direction from a retreated position and retreating it by the predetermined distance in the −Y direction is retried a predetermined number of times. If the abnormality is not resolved by retrying them the predetermined number of times, it moves on to the step S18 to perform the carryout abnormality process (steps S15 and 16 of FIG. 14). The carryout abnormality process in this case indicates the process for performing an error display on the liquid crystal display 6 and retreating the cup holder 14 to the inside of the cup port 8 to put an end to selling of the beverage thereafter.

If determined that the slide doors 11*a*, 11*b* are normally closed in the step S14, it moves on to a step S17 to perform a carryout ending process. The carryout ending process in this case indicates a process for returning the cup holder 14 moved to the inside of the cup port 8 to an initial position before beverage generation.

The actual current Ia passing through the Z-axis motor Mz on lowering the cup holder 14 in the step S6 changes subtly according to an operation environment of the Z-axis motor Mz. To follow this change, it is desirable to measure and update the reference current Is for the overload determination in adequate timing. The update timing may be every predetermined time. However, the operation environment of the Z-axis motor Mz is apt to change when the power of the beverage dispenser is turned on (step ST2 of FIG. 15), when the door of the body 1 is opened or closed (step ST3 of FIG. 15), and when the inside temperature changes (step ST4 of FIG. 15). Therefore, the current passing through the Z-axis motor Mz is measured on lowering the cup holder 14 in timing of each of the cases including the case where the reference current Is has not been measured so as to store (including rewriting) the digital value thereof as the reference current Is in the memory and set a measured flag (steps ST1, ST5 and ST6 of FIG. 15).

Thus, according to the aforementioned beverage dispenser, it is possible to provide the cup C in which the beverage is filled before the purchaser by a series of cup carryout operations of moving the cup holder 14 to advance the cup holding portion 14*a* holding the cup C in which the beverage is filled from the inside of the cup port 8 to the outside thereof to locate the cup holding portion 14*a* above the cup mount 9, lower the cup holding portion 14*a* from the above position by a predetermined distance to place the cup C on the cup mount 9 in process of lowering, and retreat the cup holding portion 14*a* from the lowered position to the inside of the cup port 8 to leave the cup on the cup mount 9. Therefore, it is possible to remarkably simplify the purchaser's operation for taking out the cup by rendering the conventional operation of putting the hand in the cup port and taking out the cup unnecessary.

Further, it is determined whether or not there is the extraneous material EM on the cup mount 9 before performing the series of cup carryout operations so as to give the warning for prompting removal of the extraneous material EM if there is the extraneous material. Therefore, it is possible to securely prevent the cup C from being mistakenly placed on the cup mount 9 in the state of having the extraneous material EM on the cup mount 9.

Furthermore, it is determined whether or not the overload ungenerable by normal operation is applied to the cup holder 14 in the process of lowering the cup holding portion 14*a* and placing the cup C on the cup mount 9 so as to give the warning for prompting the removal of the overload when determined that there is the overload. Therefore, in the case where the cup C is held by the hand H of the purchaser while the cup holder 14 is lowering halfway and the hand H is sandwiched between the cup holder 14 and the cup mount 9 for instance, it is precisely detectable.

Furthermore, if determined that there is the overload on lowering the cup holding portion 14*a*, the operation of elevating and lowering the cup holder 14 is repeated the predetermined number of times until determined that there is no overload. Therefore, it is possible to remove the overload precisely by using this retry operation time.

Furthermore, the overload is detected based on comparison between the current passing through the Z-axis motor Mz on lowering the cup holder 14 and the predetermined reference current. Therefore, it is possible to detect the overload accurately and simply.

Furthermore, the reference current is measured and updated in predetermined timing. Therefore, even in the case where the operation environment of the Z-axis motor Mz changes, it is possible to perform adequate overload detection according to the operation environment.

Furthermore, when retreating the cup holding portion 14*a* from the outside of the cup port 8 to the inside thereof, it is determined whether or not the slide doors 11*a*, 11*b* are normally closed. If determined that they are not normally closed, the operation of advancing and retreating the cup holder 14 is repeated the predetermined number of times until determined to be normal. Therefore, it is possible to close the slide doors 11*a*, 11*b* securely so as to prevent a mischief such as throwing an extraneous material into the body 1 through a gap thereof in the state of having the doors incompletely closed.

The aforementioned embodiment indicated the cup port 8 in the vertically long rectangular form. However, the form thereof is not limited in particular as long as it allows the series of cup carryout operations.

Further, the two slide doors 11*a*, 11*b* movable to the right and left are shown as the door for opening and closing the cup port 8. However, the door may also be configured by two biparting pivoted doors rotatable by using each margin as a pivot, one slide door movable to the right and left, one slide door movable up and down or one pivoted door rotatable by using one margin each on the right and left as a pivot.

Furthermore, the photosensors were indicated as the object detection sensors 12. However, the sensor other than the photosensor may also be used if capable of the same object detection.

Furthermore, the microswitches were indicated as the closing detection sensors 13*a*, 13*b*. However, the sensor other than the microswitch may also be used if capable of the same closing detection.

The preferred embodiment described in this specification is illustrative and not restrictive. The scope of the invention is indicated by the attached claims, and all the deformed examples within the meaning of the claims are included in the present invention.

What is claimed is:

1. A beverage dispenser comprising:

a cup port provided at a front surface of a body;

a cup mount provided at an outside of the cup port;

a cup holder including a cup holding portion, an internal diameter of the cup holding portion slightly smaller than a maximum external diameter of a cup in an external form like an inverted truncated cone, a right-to-left space of an opening of the cup holding portion slightly larger than a minimum external diameter of the cup, the cup holder capable of holding the cup with the cup holding portion;

a holder mover capable of moving the cup holder at least forward and backward and upward and downward; and cup carryout control means for operating the cup holder so that the holding portion holding the cup is advanced from an inside of the cup port to the outside thereof to locate the holding portion above the cup mount, the cup holding portion is lowered from an above position by a predetermined distance to place the cup on the cup mount in process of lowering, and the cup holding portion is retreated from a lowered position to the inside of the cup port to leave the cup on the cup mount.

2. The beverage dispenser according to claim 1, further comprising:

an object detection sensor for detecting whether or not there is an object on the cup mount;

extraneous material existence determining means for determining whether or not there is an extraneous material on the cup mount based on a detection signal of the object detection sensor before advancing the cup holding portion holding the cup from the inside of the cup port to the outside thereof; and extraneous material warning means for, when determined that there is the extraneous material, giving a warning for prompting removal of the extraneous material.

3. The beverage dispenser according to claim 1, further comprising:

overload detecting means for detecting whether or not an overload ungenerable by normal operation is applied to the cup holder in process of lowering the cup holding portion to place the cup on the cup mount; and overload warning means for, when determined that there is the overload, giving a warning for prompting removal of the overload.

4. The beverage dispenser according to claim 3, further comprising:

cup placement retrying means for, when determined that there is the overload, repeating an operation of elevating and lowering the cup holder a predetermined number of times until determining that there is no overload.

5. The beverage dispenser according to claim 3, wherein:

the holder mover has a motor for moving the cup holder upward and downward; and the overload detecting means includes current detecting means for detecting a current passing through the motor on lowering the cup holder and current value comparing means for determining that there is the overload in the case where a variation when a detected current exceeds a predetermined reference current is a stipulated value or higher.

6. The beverage dispenser according to claim 5, further comprising:

reference current updating means for measuring and updating the reference current in predetermined timing.

7. The beverage dispenser according to claim 1, further comprising:

a door for opening and closing the cup port;

door opening and closing means capable of opening the door on advancing the cup holding portion holding the cup from the inside of the cup port to the outside thereof and closing the door on retreating the cup holding portion from the outside of the cup port to the inside thereof;

a closing detection sensor for detecting the closing of the door;

closing determining means for determining whether or not the door is normally closed based on a detection signal of the closing detection sensor on retreating the cup holding portion from the outside of the cup port to the inside thereof; and door closing retrying means for, when determined that the closing is not normal, repeating an operation of advancing and retreating the cup holder predetermined number of times until determined to be normal.

* * * * *